US011803143B2

(12) United States Patent
Yamaguchi et al.

(10) Patent No.: US 11,803,143 B2
(45) Date of Patent: Oct. 31, 2023

(54) NIP FORMATION PAD, HEATING DEVICE, FIXING DEVICE, AND IMAGE FORMING APPARATUS

(71) Applicants: Yoshiki Yamaguchi, Kanagawa (JP); Ippei Fujimoto, Kanagawa (JP); Takashi Seto, Kanagawa (JP); Hiroshi Yoshinaga, Chiba (JP); Kentaro Yamashita, Shizuoka (JP)

(72) Inventors: Yoshiki Yamaguchi, Kanagawa (JP); Ippei Fujimoto, Kanagawa (JP); Takashi Seto, Kanagawa (JP); Hiroshi Yoshinaga, Chiba (JP); Kentaro Yamashita, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/580,703

(22) Filed: Jan. 21, 2022

(65) Prior Publication Data

US 2022/0291613 A1 Sep. 15, 2022

(30) Foreign Application Priority Data

Mar. 12, 2021 (JP) ..... 2021-040421

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035
See application file for complete search history.

(56) References Cited

U.S. PATENT DOCUMENTS

| | | | | |
|---|---|---|---|---|
| 8,843,044 | B2 * | 9/2014 | Hasegawa | G03G 15/20 430/124.32 |
| 2011/0026988 | A1 * | 2/2011 | Yoshikawa | G03G 15/2053 399/329 |
| 2011/0058864 | A1 * | 3/2011 | Fujimoto | G03G 15/2039 399/329 |
| 2013/0170879 | A1 * | 7/2013 | Yoshinaga | G03G 15/2053 399/329 |
| 2014/0056625 | A1 * | 2/2014 | Naitoh | G03G 21/1685 399/329 |
| 2014/0153983 | A1 * | 6/2014 | Fujii | G03G 15/2053 399/329 |
| 2015/0125193 | A1 * | 5/2015 | Ishii | G03G 15/2042 399/329 |
| 2017/0176906 | A1 | 6/2017 | Sawada et al. | |
| 2017/0176907 | A1 | 6/2017 | Sawada et al. | |
| 2018/0335733 | A1 | 11/2018 | Matsuda et al. | |
| 2020/0033777 | A1 | 1/2020 | Fujimoto et al. | |
| 2020/0285178 | A1 * | 9/2020 | Fujiwara | G03G 15/2053 |
| 2020/0285182 | A1 | 9/2020 | Takahashi et al. | |

FOREIGN PATENT DOCUMENTS

| | | |
|---|---|---|
| JP | 2017-181841 | 10/2017 |
| JP | 2020-149039 | 9/2020 |

* cited by examiner

*Primary Examiner* — Arlene Heredia
(74) *Attorney, Agent, or Firm* — XSENSUS LLP

(57) ABSTRACT

A nip formation pad includes a base, a high thermal conduction member, and an attachment. The high thermal conduction member has a thermal conductivity greater than a thermal conductivity of the base. The attachment is attached to the high thermal conduction member by elastic deformation of the attachment on the base held between the high thermal conduction member and the attachment.

7 Claims, 6 Drawing Sheets

NIP FORMATION PAD, HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-040421, filed on Mar. 12, 2021 in the Japan Patent Office, the entire disclosure of which is incorporated by reference herein.

BACKGROUND

Technical Field

Embodiments of the present disclosure generally relate to a nip formation pad, a beating device, a fixing device, and an image forming apparatus. In particular, the embodiments of the present disclosure relate to a nip formation pad, a heating device with the nip formation pad, a fixing device with the heating device for fixing a toner image on a recording medium, and an image forming apparatus with the fixing device for forming an image on a recording medium.

Related Art

A fixing device including a fixing belt as a belt includes a nip formation pad as a nip formation member that contacts an inner circumferential surface of the fixing belt to form a fixing nip between the fixing belt and an opposed member such as a pressure roller.

The nip formation member generally has a configuration including a high thermal conduction member having a relatively high thermal conductivity and contacting the fixing belt to uniform the temperature distribution of the fixing belt in a width direction of the fixing belt. The high thermal conduction member is fixed to and integrated with a base of the nip formation member to prevent the high thermal conduction member from being displaced or falling off.

SUMMARY

This specification describes an improved nip formation pad that includes a base, a high thermal conduction member, and an attachment. The high thermal conduction member has a thermal conductivity greater than a thermal conductivity of the base. The attachment is attached to the high thermal conduction member by elastic deformation of the attachment on the base held between the high thermal conduction member and the attachment.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
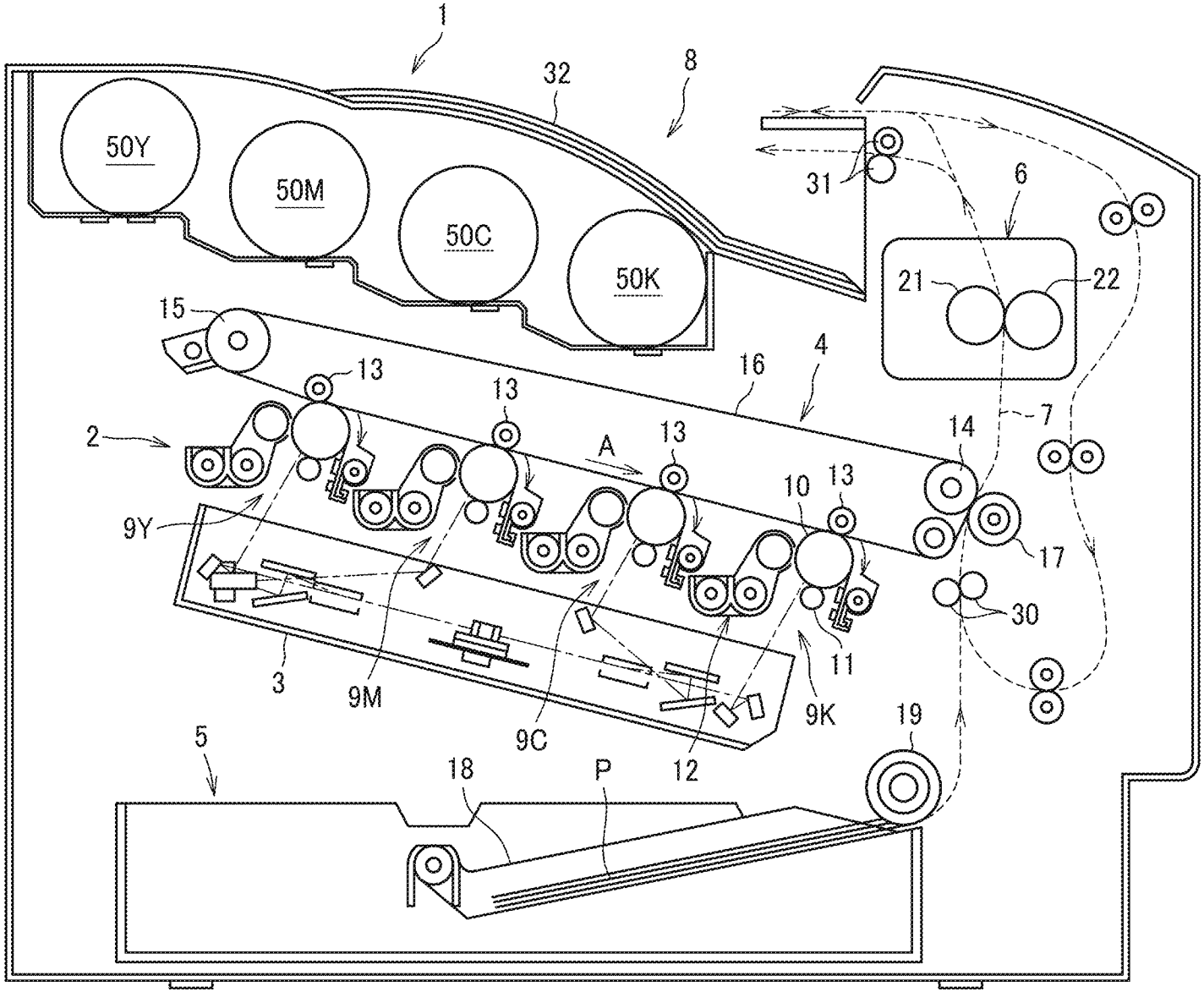
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Referring to the drawings, embodiments of the present disclosure are described below. The following is a description of a fixing device to heat and fix a toner image onto a sheet as a recording medium, as an example of a heating device including a nip formation member, and a description of an image forming apparatus including the fixing device. Identical reference numerals are assigned to identical components or equivalents and a description of those components is simplified or omitted.

As illustrated in FIG. 1, the image forming apparatus 1 includes an image forming section 2 disposed in a center portion of the image forming apparatus 1. The image forming section 2 includes four process units 9Y, 9M, 9C, and 9K removably installed in the image forming apparatus 1. The process units 9Y, 9M, 9C, and 9K have substantially the identical configurations to each other, except for colors of developers (toners) supplied from toner bottles 50Y, 50M, 50C, and 50K. Suffixes, which are Y, M, C, and K, are used to indicate respective colors of developers (e.g., yellow, cyan, magenta, and black toners) for the process units 9Y, 9M, 9C, and 9K. Hereinafter, the process units 9Y, 9M, 9C, and 9K are occasionally referred to in a single form, for example, the process unit 9, for convenience.

Specifically, the process unit 9 includes a photoconductor drum 10, a charging roller 11, and a developing device 12 including a developing roller. The photoconductor drum 10 is a drum-shaped rotator serving as an image bearer that bears toner as a developer on a surface of the photoconductor drum 10. The charging roller 11 uniformly charges the surface of the photoconductor drum 10. The developing roller supplies toner to the surface of the photoconductor drum 10.

Below the process units 9Y, 9C, 9M, and 9K, an exposure device 3 is disposed. The exposure device 3 emits laser light beams based on image data.

Above the image forming section 2, a transfer section 4 is disposed. The transfer section 4 includes a driving roller 14, a driven roller 15, an intermediate transfer belt 16, and primary transfer rollers 13. The intermediate transfer belt 16 is an endless belt stretched around the driving roller 14 and the driven roller 15 so as to be able to travel around. The primary transfer rollers 13 are disposed opposite the photoconductor drums 10 of the process units 9Y, 9M, 9C, and 9K via the intermediate transfer belt 16. At the position opposite the corresponding photoconductor drum 10, each primary transfer roller 13 presses an inner circumferential surface of the intermediate transfer belt 16 against the corresponding photoconductor drum 10 to form a primary transfer nip between a pressed portion of the intermediate transfer belt 16 and the photoconductor drum 10.

The image forming section 2 and the transfer section 4 configure an image forming device for forming an image on a sheet in the image forming apparatus 1.

A secondary transfer roller 17 is disposed opposite the driving roller 14 via the intermediate transfer belt 16. The secondary transfer roller 17 is pressed against an outer circumferential surface of the intermediate transfer belt 16 to form a secondary transfer nip between the secondary transfer roller 17 and the intermediate transfer belt 16.

The sheet feeder 5 includes a sheet tray 18 and a sheet feeding roller 19. The sheet tray 18 in a lower portion of the of the image forming apparatus 1 accommodates sheets P as recording media. The sheet feeding roller 19 feeds the sheet P accommodated in the sheet tray 18.

The sheets P are conveyed along a conveyance path 7 from the sheet feeder 5 toward a sheet ejector 8. Conveyance roller pairs including a registration roller pair 30 are disposed along the conveyance path 7.

The fixing device 6 includes a fixing belt 21 and a pressure roller 22. A heater heats the fixing belt 21. The pressure roller 22 presses the fixing belt 21.

The sheet ejector 8 is disposed in an extreme downstream part of the conveyance path 7 in a direction of conveyance of the sheet P (hereinafter referred to as a sheet conveyance direction) in the image forming apparatus 1. The sheet ejector 8 includes a sheet ejection roller pair 31 and an output tray 32. The sheet ejection roller pair 31 ejects the sheets P onto the output tray 32 disposed atop a housing of the image forming apparatus 1. Thus, the sheets P lie stacked on the output tray 32.

Next, a description is given of a basic operation of the image forming apparatus 1 with reference to FIG. 1.

As the image forming apparatus 1 receives a print job and starts an image forming operation, the exposure device 3 emits laser light beams onto the outer circumferential surfaces of the photoconductor drums 10 of the process units 9Y, 9M. 9C, and 9K according to image data, thus forming electrostatic latent images on the photoconductor drums 10. The image data used to expose the respective photoconductor drums 10 by the exposure device 3 is monochrome image data produced by decomposing a desired full color image into yellow, magenta, cyan, and black image data. After the exposure device 3 forms the electrostatic latent images on the photoconductor drums 10, the drum-shaped developing rollers of the developing devices 12 supply yellow, magenta, cyan, and black toners stored in the developing devices 12 to the electrostatic latent images, rendering visible the electrostatic latent images as developed visible images, that is, yellow, magenta, cyan, and black toner images, respectively.

In the transfer section 4, the intermediate transfer belt 16 moves along with rotation of the driving roller 14 in a direction indicated by arrow A in FIG. 1. A power supply applies a constant voltage or a constant current control voltage having a polarity opposite a polarity of the toner to each primary transfer roller 13. As a result, a transfer electric field is formed at the primary transfer nip. The yellow, magenta, cyan, and black toner images are primarily transferred from the photoconductor drums 10 onto the intermediate transfer belt 16 successively at the primary transfer nips such that the yellow, magenta, cyan, and black toner images are superimposed on the intermediate transfer belt 16.

On the other hand, as the image forming operation starts, the sheet feeding roller 19 of the sheet feeder 5 disposed in the lower portion of the image forming apparatus 1 is driven and rotated to feed the sheet P from the sheet tray 18 toward the registration roller pair 30 through the conveyance path 7. The registration roller pair 30 conveys the sheet P fed to the conveyance path 7 by the sheet feeding roller 19 to the secondary transfer nip formed between the secondary transfer roller 17 and the intermediate transfer belt 16 supported by the driving roller 14, timed to coincide with the superimposed toner image on the intermediate transfer belt 16. At this time, a transfer voltage having a polarity opposite the toner charge polarity of the toner image formed on the surface of the intermediate transfer belt 16 is applied to the sheet P. and the transfer electric field is generated in the secondary transfer nip. Due to the transfer electric field generated in the secondary transfer nip, the toner images formed on the intermediate transfer belt 16 are collectively transferred onto the sheet P.

After the toner image is transferred onto the sheet P, the sheet P is conveyed to the fixing device 6. In the fixing device 6, heat and pressure are applied to the sheet P by the fixing belt 21 and the pressure roller 22, so that the toner image formed on the sheet P is fixed to the sheet P. The sheet P bearing the fixed toner image is separated from the fixing belt 21 and conveyed by one or more of the conveyance roller pairs to the sheet ejector 8. The sheet ejection roller pair 31 of the sheet ejector 8 ejects the sheet P onto the output tray 32.

The above describes the image forming operation of the image forming apparatus 1 to form the full color toner image on the sheet P. Alternatively, the image forming apparatus 1 may form a monochrome toner image by using any one of the four process units 9Y, 9M, 9C, and 9K or may form a bicolor toner image or a tricolor toner image by using two or three of the process units 9Y, 9M, 9C, and 9K.

Figure 2:
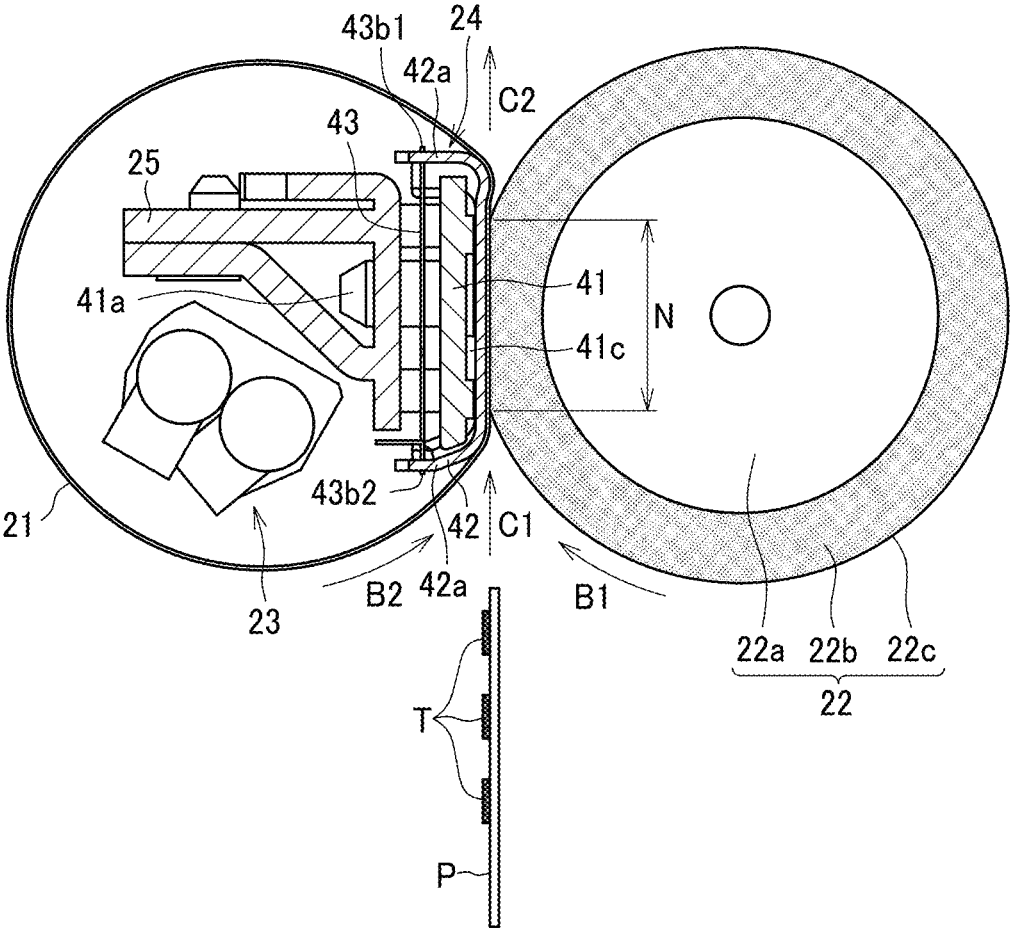
FIG. 2 is a schematic sectional view of a fixing device incorporated in the image forming apparatus of FIG. 1.

With reference to FIG. 2, a detailed description is provided of a basic configuration of the fixing device 6.

As illustrated in FIG. 2, the fixing device 6 includes the fixing belt 21 as a fixing member, the pressure roller 22 as an opposed rotator, halogen heaters 23 as heat generators, a nip formation pad 24, a stay 25 as a support, and a pressurization assembly. The fixing belt 21 is a rotatable endless belt. The pressure roller 22 is an opposed member rotatably disposed opposite an outer circumferential surface of the fixing belt 21. The halogen heater 23 heats the fixing belt 21. The nip formation pad 24 is disposed inside the loop of the fixing belt 21. The stay 25 is a contact member that contacts a rear side of the nip formation pad 24 to support the nip formation pad 24. The pressurization assembly presses the pressure roller 22 against the fixing belt 21.

The fixing belt 21, the pressure roller 22, the halogen heater 23, the nip formation pad 24, and the stay 25 extend in a direction perpendicular to the sheet surface of FIG. 2. Hereinafter, the direction is referred to as a longitudinal direction of the fixing belt 21 or the like. The longitudinal direction is also the width direction of the sheet passing through the fixing device 6.

The fixing belt 21 is a thin, flexible, endless belt (which may be a film). Specifically, the fixing belt 21 includes a base including the inner circumferential surface of the fixing belt 21 and a release layer including the outer circumferential surface of the fixing belt 21. Optionally, an elastic layer made of rubber such as silicone rubber, silicone rubber foam, and fluoro rubber may be interposed between the base and the release layer. The base of the fixing belt 21 is made of metal, such as nickel or steel use stainless (SUS), or resin such as polyimide (PI). The release layer of the fixing belt 21 is made of tetrafluoroethylene-perfluoroalkylvinylether copolymer (PFA) or polytetrafluoroethylene (PTFE) or the like.

The pressure roller 22 includes a cored bar 22*a*; an elastic layer 22*b* disposed on the surface of the cored bar 22*a*, and a release layer 22*c* disposed on the surface of the elastic layer 22*b*. The elastic layer 22*b* is made of silicone rubber foam, silicone rubber, fluoro rubber, or the like. The release layer 22*c* is made of PFA, PTFE, or the like. The pressurization assembly presses the pressure roller 22 against the nip formation pad 24 via the fixing belt 21. The pressure roller 22 in pressure contact with the fixing belt 21 deforms the elastic layer 22*b* of the pressure roller 22, thus defining a fixing nip N having a specified width, which is a specified length in the sheet conveyance direction, between the fixing belt 21 and the pressure roller 22. A driver such as a motor disposed inside the image forming apparatus 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the fixing belt 21 and the pressure roller 22.

According to the present embodiment, the pressure roller 22 is a solid roller. Alternatively, the pressure roller 22 may be a hollow roller. In a case in which the pressure roller 22 is a hollow roller, a heat source such as a halogen heater may be disposed inside the pressure roller 22. If the pressure roller 22 does not include the elastic layer 22*b*, the pressure roller 22 has a decreased thermal capacity and can be heated quickly to a predetermined fixing temperature at which a toner image T is fixed on the sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this circumstance, preferably, the pressure roller 22 includes the elastic layer not thinner than 100 μm. The elastic layer not thinner than 100 μm disposed in the pressure roller 22 elastically deforms to absorb the slight surface asperities in the fixing belt 21, thus preventing uneven gloss of the toner image on the sheet P. The elastic layer 22*b* of the pressure roller 22 may be made of solid rubber. Alternatively, if no heater is disposed inside the pressure roller 22, the elastic layer of the pressure roller 22 may be made of sponge rubber. The sponge rubber is preferable to the solid rubber because the sponge rubber has enhanced thermal insulation and so draws less heat from the fixing belt 21. According to this embodiment, the pressure roller 22 is pressed against the fixing belt 21. Alternatively, the fixing rotator may merely contact the opposed member with no pressure therebetween.

Both ends of the halogen heater 23 are fixed to side plates of the fixing device 6. A power supply disposed inside the main body of the image forming apparatus 1 supplies power to the halogen heater 23 so that the halogen heater 23 generates heat. A controller operatively connected to the halogen heater 23 and the temperature detector 27 controls the halogen heater 23 based on the temperature of the surface of the fixing belt 21, which is detected by the temperature detector 27. Such heating control of the halogen heater 23 adjusts the temperature of the fixing belt 21 to a desired fixing temperature. As a heater to heat the fixing belt 21, an induction heater (IH), a resistive heat generator, a carbon heater, or the like may be employed instead of the halogen heater 23.

A back surface of the nip formation pad 24 is secured to and supported by the stay 25. Accordingly, even if the nip formation pad 24 is pressed by the pressure roller 22, the stay 25 prevents the nip formation pad 24 from being bent by the pressure of the pressure roller 22 and therefore allows the nip formation pad 24 to maintain a uniform nip length of the fixing nip N over the entire width of the pressure roller 22 in the longitudinal direction. A detailed description of a configuration of the nip formation pad 24 is deferred.

The stay 25 is in contact with the back surface of the nip formation pad 24 over the longitudinal direction of the nip formation pad 24 to support the nip formation pad 24 against the pressure from the pressure roller 22. The above-described configuration mainly reduces the bend of the nip formation pad 24 in the longitudinal direction. Preferably, the stay 25 is made of metal having an increased mechanical strength, such as stainless steel and iron, to prevent bending of the nip formation pad 24. Alternatively, the stay 25 may be made of resin.

A description is now given of various structural advantages of the fixing device 6 to enhance energy saving and shorten a first print time taken to output the sheet P bearing the fixed toner image upon receipt of a print job through preparation for a print operation and the subsequent print operation. For example, the fixing device 20 employs a direct heating method in which the halogen heater 23 directly heats the fixing belt 21 in a circumferential direct heating span on the fixing belt 21 other than the fixing nip N. According to the present embodiment, no component is interposed between a left side of the halogen heater 23 and the fixing belt 21 in FIG. 2 such that the halogen heater 23 radiates heat directly to the circumferential direct heating span on the fixing belt 21.

In order to decrease the thermal capacity of the fixing belt 21, the fixing belt 21 is thin and has a decreased loop diameter. For example, the base layer of the fixing belt 21 is designed to have a thickness of from 20 μm to 50 μm, the elastic layer is designed to have a thickness of from 100 μm to 300 μm, and the release layer is designed to have a thickness of from 10 μm to 50 μm. Thus, the fixing belt 21 is designed to have a total thickness not greater than 1 mm. The loop diameter of the fixing belt 21 is set in a range of from 20 mm to 40 mm. In order to further decrease the thermal capacity of the fixing belt 21, preferably, the fixing belt 21 may have the total thickness not greater than 0.20 mm and more preferably not greater than 0.16 mm. Preferably, the loop diameter of the fixing belt 21 may be 30 mm or less.

According to the present embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, the curvature of the fixing belt 21 is smaller than the curvature of the pressure roller 22 at the fixing nip N, thus facilitating separation of the sheet P as the recording medium from the fixing belt 21 when the sheet P is ejected from the fixing nip N.

With continued reference to FIG. 2, a description is now given of a fixing operation of the fixing device 6 according to the present embodiment.

As the image forming apparatus 1 illustrated in FIG. 1 is powered on, the halogen heater 23 is supplied with power, and the driver starts driving and rotating the pressure roller 22 in a clockwise direction of rotation indicated by arrow B1 as illustrated in FIG. 2. The rotation of the pressure roller 22 drives the fixing belt 21 to rotate in a counterclockwise direction of rotation indicated by arrow B2 as illustrated in FIG. 2 by friction between the fixing belt 21 and the pressure roller 22.

Thereafter, the sheet P bearing the unfixed toner image T formed in the image forming processes described above is conveyed in a direction indicated by arrow C1 in FIG. 2 while being guided by a guide plate and enters the fixing nip N. The toner image T is fixed 1) onto the sheet P under heat from the fixing belt 21 heated by the halogen heater 23 and pressure exerted between the fixing belt 21 and the pressure roller 22.

The sheet P bearing the fixed toner image T is sent out from the fixing nip N and conveyed in a direction indicated by arrow C2 in FIG. 2. As a leading edge of the sheet P contacts a front edge of the separator, the separator separates the sheet P from the fixing belt 21. The sheet P separated from the fixing belt 21 is ejected by the sheet ejection roller pair 31 depicted in FIG. 1 to the outside of the image forming apparatus 1 and stacked on the output tray 32.

Figure 3:
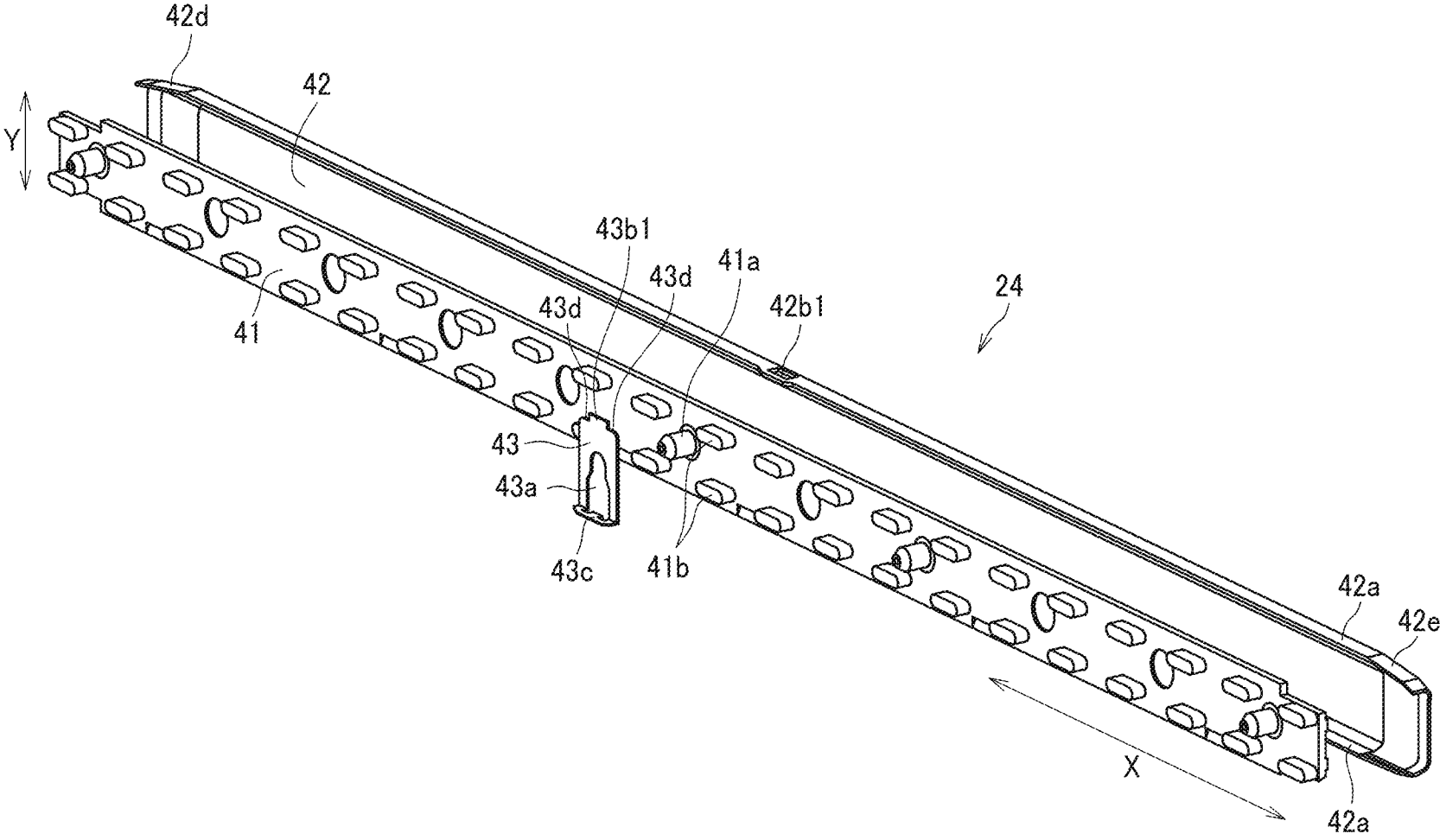
FIG. 3 is an exploded perspective view of a nip formation pad to illustrate parts of the nip formation pad in the fixing device of FIG. 2.

Referring now to FIGS. 2 and 3, a detailed description is given of the nip formation pad 24 incorporated in the fixing device 6 described above. FIG. 3 is an exploded perspective view of the nip formation pad 24. A direction indicated by a bidirectional arrow X in FIG. 3 is the longitudinal direction of the nip formation pad 24. In addition, a direction that intersects the longitudinal direction and is different from a thickness direction of the nip formation pad 24 is referred to as a short-side direction of the nip formation pad 24. In the present embodiment, the short-side direction is orthogonal to the longitudinal direction.

As illustrated in FIGS. 2 and 3, the nip formation pad 24 includes a base 41, a high thermal conduction member or structure 42, and an attachment 43. The base 41 and the high thermal conduction member 42 extend in the longitudinal direction of the nip formation pad 24.

The base 41 is made of a heat-resistant material such as an inorganic substance, rubber, resin, or a combination thereof. Examples of the inorganic substance include ceramic, glass, and aluminum. Examples of the rubber include silicone rubber and fluororubber. An example of the resin is fluororesin such as polytetrafluoroethylene (PTFE), perfluoroalkoxy alkane (PFA), ethylenetetrafluoroethylene (ETFE), and tetrafluoroethylene-hexafluoropropylene copolymer (FEP). Other examples of the resin include polyimide (PI), polyamideimide (PAI), polyphenylene sulfide (PPS), polyether ether ketone (PEEK), liquid crystal polymer (LCP), phenolic resin, nylon and aramid.

In the present embodiment, the base 41 is made of LCP having enhanced heat resistance and moldability. The base 41 has a thermal conductivity of, e.g., 0.54 watts per meter-kelvin (W/(m K)).

The base 41 has a positioning projection 41*a* on a center portion of the base 41 in the longitudinal direction of the base 41 to position the attachment 43 with respect to the base 41. The positioning projection 41*a* is a boss projecting toward the stay 25 (that is, toward the left side in FIG. 2). Inserting the positioning projection 41*a* into the stay 25 positions the base 41 (and the nip formation pad 24) with respect to the stay 25. For example, the positioning projection 41*a* is inserted into a hole of the stay 25 to restrict movement of the nip formation pad 24 in the longitudinal direction and movement of the nip formation pad 24 in the short-side direction with respect to the stay 25. In other words, the above-described structure positions the nip formation pad 24 with respect to the fixing device 6 in the longitudinal direction and the short-short-side direction.

As illustrated in FIG. 3, the base 41 includes a plurality of projections 41*b* projecting toward the stay 25 in addition to the positioning projection 41*a*. The plurality of projections 41*b* includes projections 41*b* arranged in the longitudinal direction of the base 41 in two lines in the short-side direction of the base 41. The projections 41*b* are in contact with the stay 25. The above-described structure positions the nip formation pad 24 with respect to the stay 25 in the thickness direction of the nip formation pad 24 that is the lateral direction of FIG. 2.

As illustrated in FIG. 2, the base 41 has a recess 41*c* opening toward the high thermal conduction member 42. The recess 41*c* reduces a contact area of the base 41 with the high thermal conduction member 42 and reduces the amount of heat flowing from the fixing belt 21 to the base 41 via the high thermal conduction member 42.

The high thermal conduction member 42 is in contact with the inner circumferential surface of the fixing belt 21. The high thermal conduction member 42 is made of a material having a thermal conductivity higher than a thermal conductivity of the base 41. The high thermal conduction member 42 in the present embodiment is made of aluminum, and the thermal conductivity of the high thermal conduction member is set to be, for example, about 236 W/m·K. Alternatively, the high thermal conduction member 42 may be made of SUS having a thermal conductivity from 16.7 W/m·K to 20.9 W/m·K or a copper-based material having a thermal conductivity of, e.g., 381 W/m·K.

Next, a method of calculating the thermal conductivity is described. In order to calculate the thermal conductivity, the thermal diffusivity of a target object is firstly measured. Using the thermal diffusivity, the thermal conductivity is calculated.

The thermal diffusivity is measured using a thermal diffusivity/conductivity measuring device (trade name: ai-Phase Mobile Iu, manufactured by Ai-Phase co., ltd.).

In order to convert the thermal diffusivity into thermal conductivity, values of density and specific heat capacity are necessary.

The density is measured by a dry automatic densitometer (trade name: Accupyc 1330 manufactured by Shimadzu Corporation).

The specific heat capacity is measured by a differential scanning calorimeter (trade name: DSC-60 manufactured by Shimadzu Corporation), and sapphire is used as a reference material in which the specific heat capacity is known. In the present embodiment, the specific heat capacity is measured five times, and an average value at 50° C. is used. The thermal conductivity λ is obtained by the following formula (1). $\lambda=\rho\times C\times\alpha$. (1) where ρ is the density, C is the specific heat capacity, and α is the thermal diffusivity obtained by the thermal diffusivity measurement described above.

The high thermal conduction member 42 contacting the fixing belt 21 along the longitudinal direction conducts and equalizes heat of the fixing belt 21 in the longitudinal direction. Thus, the high thermal conduction member 42 reduces temperature unevenness of the fixing belt 21 in the longitudinal direction.

The high thermal conduction member 42 has bent portions 42*a* bent from both ends in a short-side direction of the high thermal conduction member 42 and disposed along a longitudinal direction of the high thermal conduction member 42. In the present embodiment, to form the high thermal conduction member 42 having the bent portions 42*a*, both end portions of a metal plate in the short-side direction that are an upper side and a lower side in FIG. 2 are bent toward a direction substantially perpendicular to the short-side direction, that is, the left side in FIG. 2, in other words, a direction away from the fixing nip N.

As illustrated in FIG. 3, the high thermal conduction member 42 has insertion holes 42*b*1 and 42*b*2 (see FIG. 5) in middle portions of the bent portions 42*a* in the longitudinal direction. The insertion holes 42*b*1 and 42*b*2 are at both sides of the high thermal conduction member 42 in the short-side direction of the high thermal conduction member. As illustrated in FIG. 3, the middle portions having the insertion holes 42*b*1 and 42*b*2 in the bent portions 42*a* are shaped so as to partially project in a direction in which the high thermal conduction member 42 is bent away from the fixing nip N, beyond other portions of the bent portions 42*a*. The high thermal conduction member 42 includes converging portions 42*d* and 42*e* on opposed longitudinal end portions of the high thermal conduction member 42, respectively. The converging portions 42*d* and 42*e* narrow the high thermal conduction member 42 in the short-side direction of the high thermal conduction member 42 toward opposed longitudinal edges of the high thermal conduction member 42, respectively. The converging portions 42*d* and 42*e* restrict movement of the base 41 in the longitudinal direction with respect to the high thermal conduction member 42 but do not completely restrict the movement in the longitudinal direction to allow thermal expansion of the base 41 in the longitudinal direction.

The attachment 43 is an elastically deformable member. In the present embodiment, the attachment 43 is a flat spring made of steel use stainless (SUS).

The attachment 43 has a positioning hole 43*a* to position the positioning projection 41*a* of the base 41. The attachment 43 has insertion portions 43*b*1 and 43*b*2 (see FIG. 5) at both ends of the attachment 43.

Figure 4:
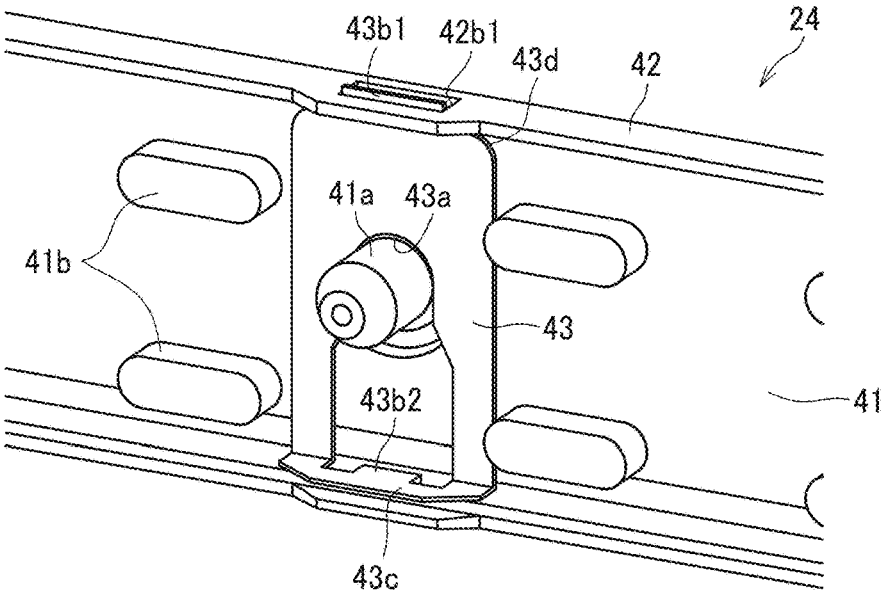
FIG. 4 is a perspective view of an attachment attached to the nip formation pad of FIG. 3.
Figure 5:
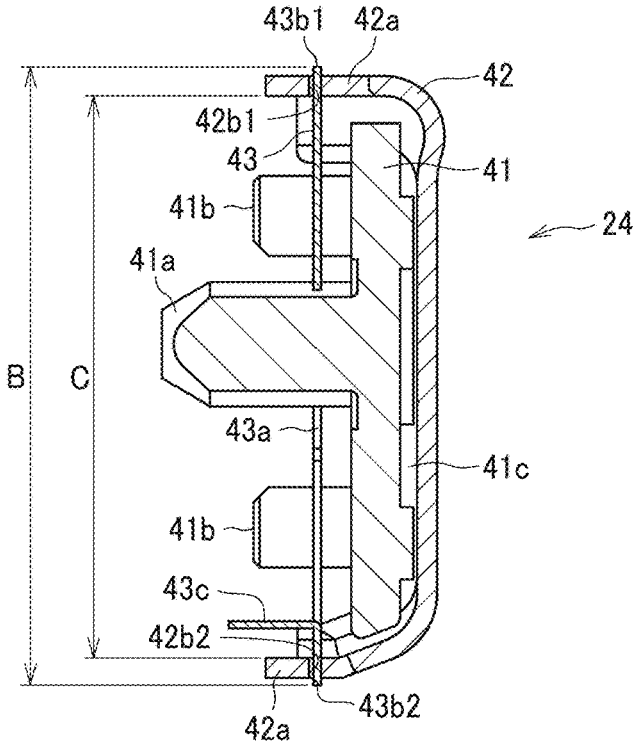
FIG. 5 is a side cross-sectional view of the nip formation pad of FIG. 3.

FIG. 4 is a perspective view of the attachment 43 attached to the nip formation pad 24, and FIG. 5 is a cross-sectional view of the nip formation pad 24 with the attachment 43.

As illustrated in FIGS. 4 and 5, the insertion portions 43*b*1 and 43*b*2 of the attachment 43 are inserted into the corresponding insertion holes 42*b*1 and 42*b*2 of the high thermal conduction member 42, respectively to attach the attachment 43 to the high thermal conduction member 42. The attachment 43 is attached to the high thermal conduction member 42 so that the base 41 is sandwiched between the attachment 43 and the high thermal conduction member 42. The above-described structure holds the base 41 between the high thermal conduction member 42 and the attachment 43.

The attachment 43 has a length B from the end of the insertion portion 43*b*1 to the end of the insertion portion 43*b*2 (in the present embodiment, the entire length B of the attachment 43) that is set to be longer than the length C between the bent portions 42*a* having the insertion holes 42*b*1 and 42*b*2 of the high thermal conduction member 42. The attachment 43 has a bent portion 43*c* extending in a direction intersecting with a direction in which the body of the attachment 43 extends (in the present embodiment, a direction orthogonal to the body of the attachment 43, i.e., the lateral direction in FIG. 5). The bent portion 43*c* is held by an operator during an attachment operation described below to attach the attachment 43 to the high thermal conduction member 42.

As illustrated in FIG. 4, the positioning projection 41*a* of the base 41 is inserted into an upper portion of the positioning hole 43*a* of the attachment 43. The above-described structure positions the attachment 43 with respect to the base 41. The positioning hole 43*a* has not only the upper portion into which the positioning projection 41*a* is inserted but also a lower hole portion. Enlarging a range of the positioning hole 43*a* as described above reduces the rigidity of the attachment 43 and configures the attachment 43 to be easily and elastically deformed.

Next, assembling processes of the nip formation pad 24 is described.

Figure 6:
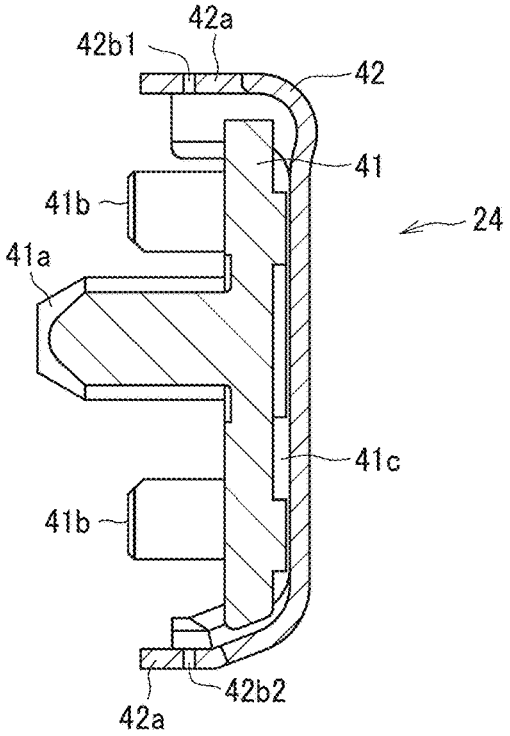
FIG. 6 is a side cross-sectional view of the nip formation pad of FIG. 3 to illustrate an assembling process.
Figure 7:
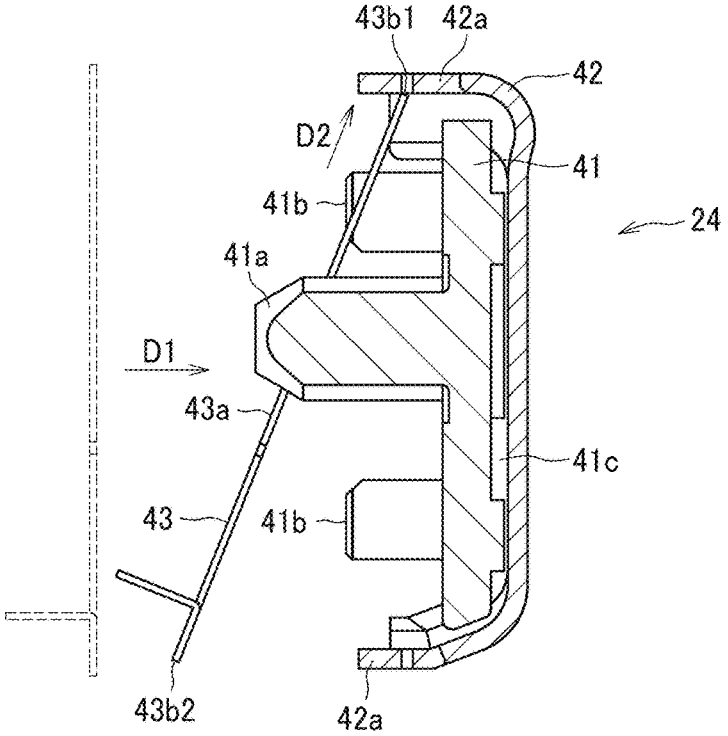
FIG. 7 is a side cross-sectional view of the nip formation pad of FIG. 3 to illustrate an assembling process following the assembling process illustrated in FIG. 6.

First, as illustrated in FIG. 6, the base 41 is placed in a recessed portion between both bent portions 42*a* of the high thermal conduction member 42. Then, as illustrated in FIG. 7, the attachment 43 is moved toward the high thermal conduction member 42 in a direction indicated by arrow D in FIG. 7 and obliquely moved to the high thermal conduction member 42 in a direction indicated by arrow D2 in FIG. 7. Thus, the one insertion portion 43*b*1 is inserted into the insertion hole 42*b*1, and the positioning projection 41*a* of the base 41 is inserted into the positioning hole 43*a* of the attachment 43.

Figure 8:
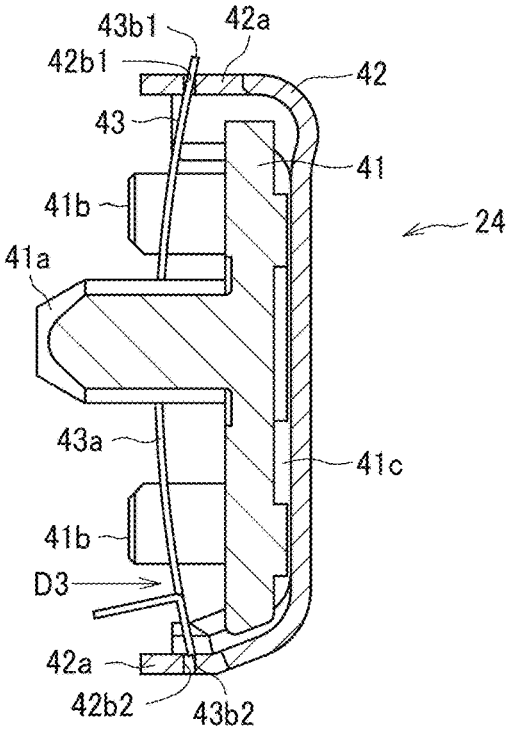
FIG. 8 is a side cross-sectional view of the nip formation pad of FIG. 3 to illustrate an assembling process following the assembling process illustrated in FIG. 7.

Then, as illustrated in FIG. 8, the insertion portion 43*b*1 is inserted into the insertion hole 42*b*1, and the attachment 43 is elastically deformed to insert the other insertion portion 43*b*2 into the insertion hole 42*b*2. Specifically, the operator applies force in a direction indicated by arrow D3 to the insertion portion 43*b*1 of the attachment 43 with a portion at which the insertion portion 43*b*1 abuts against the inner walls of the insertion hole 42*b*1 as a fulcrum (for example, the operator holds the bent portion 43*c* and pushes the bent portion 43*c* in the direction indicated by arrow D3) to elastically deform the attachment 43 and insert the insertion portion 43*b*2 into the insertion hole 42*b*2.

After the operator inserts the insertion portion 43*b*2 into the insertion hole 42*b*2, the operator releases pushing the attachment 43 so that the attachment 43 elastically returns. As a result, as illustrated in FIG. 5, the attachment 43 is attached to the high thermal conduction member 42, and the nip formation pad 24 is assembled. In the above description, the insertion portion 43*b*1 is firstly inserted into the insertion hole 42*b*1, and the insertion portion 43*b*2 is secondly inserted into the insertion hole 42*b*2, but this order may be reversed.

As described above, the attachment 43 in the present embodiment is elastically deformed and attached to the high thermal conduction member 42. Specifically, after one insertion portion 43*b*1 of the attachment 43 is inserted into the insertion hole 42*b*1, the other insertion portion 43*b*2 is set inside the bent portion 42*a*. That is, the attachment 43 is disposed in the recessed portion between both bent portions 42*a* of the high thermal conduction member 42, and the other insertion portion 43$b$2 is inserted into the insertion hole 42$b$2. However, strictly speaking, the entire attachment 43 is not necessarily disposed in the recessed portion, and the end of the insertion portion 43$b$1 may be outside the recessed portion via the insertion hole 42$bi$. As a result, the attachment 43 is attached to the high thermal conduction member 42 (and the nip formation pad 24) with a simple configuration without using another member such as a screw for screw fastening.

Screwing the attachment 43 to the nip formation pad 24 or directly screwing the base 41 to the high thermal conduction member 42 to fix the base 41 and the high thermal conduction member 42 each other may generate chips and cause falling off the screw from a female screw portion. The chips and the screw damages the fixing belt 21 and may cause an abnormal image. In contrast, the attachment 43 in the present embodiment is attached to the high thermal conduction member 42 without using another member such as the screw as described above, and the damage to the fixing belt 21 is prevented. In addition, the number of pans of the nip formation pad 24 is reduced.

Attaching the attachment 43 enables assembling the base 41 to the high thermal conduction member 42 without falling the base 41 and the high thermal conduction member 42 and positioning the base 41 to the high thermal conduction member 42. Specifically, fitting the positioning projection 41$a$ to the positioning hole 43$a$ of the base 41 restricts the movement of the base 41 in the longitudinal direction with respect to the attachment 43. Since the movement of the insertion portions 43$b$1 and 43$b$2 is restricted in the insertion holes 42$b$1 and 42$b$2, the attachment 43 is positioned with respect to the high thermal conduction member 42 in the longitudinal direction. Accordingly, the base 41 is positioned in the longitudinal direction with respect to the high thermal conduction member 42.

Holding the base 41 between both bent portions 42$a$ of the high thermal conduction member 42 positions the base 41 in the short-side direction of the high thermal conduction member 42. An inner wall of the positioning holes 43$a$ of the attachment 43 is in contact with the positioning projection 41$a$ of the base 41 to restrict the downward movement of the attachment 43 relative to the base 41 in FIG. 5. The above-described structure restricts the downward movement of the attachment 43 with respect to the high thermal conduction member 42 in FIG. 5 to prevent the insertion portion 43$b$1 from falling off from the insertion hole 42$b$1. In addition, upper edges 43$d$ (see FIG. 3) of the attachment 43 is in contact with the lower side of the bent portion 42$a$ of the high thermal conduction member 42 to restrict the upward movement of the attachment 43 with respect to the high thermal conduction member 42 in FIG. 5. The above-described structure prevents the insertion portion 43$b$2 from falling off from the insertion hole 42$b$2.

Since the movement of the insertion portions 43$b$1 and 43$b$2 is restricted in the insertion holes 42$b$1 and 42$b$2, the movement of the attachment 43 is restricted with respect to the high thermal conduction member 42 in the thickness direction of the high thermal conduction member 42 that is the lateral direction in FIG. 5. Since the base 41 is sandwiched between the attachment 43 and the high thermal conduction member 42, the movement of the base 41 in the thickness direction is restricted. The above-described structure restricts the movement of the base 41 in the thickness direction with respect to the high thermal conduction member 42.

The attachment 43 in the present embodiment is attached to the high thermal conduction member 42 as described above to position the base 41 and the high thermal conduction member 42 in each direction (the longitudinal direction, the short-side direction, and the thickness direction), but the base 41 and the high thermal conduction member 42 are not completely fixed. The above-described configuration prevents deformation of members such as warp of members caused by thermal expansion of the base 41 and the high thermal conduction member 42. Since the base 41 and the high thermal conduction member 42 are made of different materials and have different coefficients of thermal expansion, the base 41 and the high thermal conduction member 42 have different amounts of deformation caused by heat transferred from the fixing belt 21. Fixing the base 41 to the high thermal conduction member 42 by, for example, screwing or attachment using an adhesive causes the deformation of the members such as warp of the members due to a difference in thermal expansion coefficient between the base 41 and the high thermal conduction member 42. However, in the present embodiment, such deformation of the member is prevented.

As illustrated in FIG. 5, setting the length B from the end of the insertion portion 43$b$1 to the end of the insertion portion 43$b$2 larger than the length C enables easily attaching the attachment 43 to the high thermal conduction member 42 by elastic deformation, and after the attachment, not easily detaching the insertion portions 43$b$1 and 43$b$2 from the insertion holes 42$b$1 and 42$b$2 as described above. That is, the attachment 43 is not easily detached from the high thermal conduction member 42, and the base 41 and the high thermal conduction member 42 are assembled without being detached from each other.

In the present embodiment, the positioning projection 41$a$ of the base 41 positions the base 41 with respect to the high thermal conduction member 42 via the attachment 43 and positions the base 41 with respect to the stay 25 as described above. In other words, one positioning projection 41$a$ positions the base 41 with respect to the high thermal conduction member 42 and positions the nip formation pad 24 with respect to the stay 25. Such a simple configuration improves the accuracy of positioning of each member described above. Positioning the high thermal conduction member 42 of the nip formation pad 24 with respect to the stay 25 in the longitudinal direction improves the thermal conduction efficiency of the fixing belt 21 at a target position of the fixing belt 21. Positioning the nip formation pad 24 with respect to the stay 25 in the longitudinal direction enables forming the fixing nip N on a target region of the fixing belt 21.

The above-described embodiments are illustrative and do not limit this disclosure. It is therefore to be understood that within the scope of the appended claims, numerous additional modifications and variations are possible to this disclosure otherwise than as specifically described herein.

Figure 9:
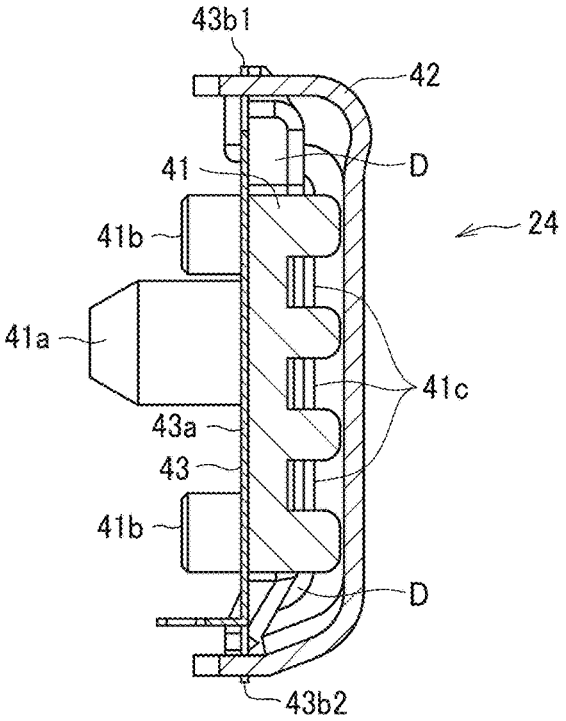
FIG. 9 is a cross-sectional view of the nip formation pad according to another embodiment.

FIG. 9 illustrates a nip formation pad 24 including a base 41 having a shape different from the shape of the base 41 in the above-described embodiment.

As illustrated in FIG. 9, the base 41 of the present embodiment has a smaller contact area with the high thermal conduction member 42 than the base 41 of the above-described embodiment. Specifically, the base 41 has a plurality of recesses 41$c$ in contact with the high thermal conduction member 42 to reduce the contact area with the high thermal conduction member 42 in contact with the fixing belt 21. In addition, the base 41 has a smaller width in the short-side direction of the base 41 that is the vertical direction in FIG. 9 than the width of the high thermal conduction member 42, and the base 41 and the high thermal conduction member 42 form gaps D between the high thermal conduction member 42 and both sides of the base 41 in the short-side direction. The above-described structure minimizes the amount of heat flowing from the fixing belt 21 to the base 41 through the high thermal conduction member 42. That is, the fixing device 6 can efficiently heat the fixing belt 21.

The image forming apparatus according to the present embodiments of the present disclosure is applicable not only to a color image forming apparatus 100 illustrated in FIG. 1 but also to a monochrome image forming apparatus, a copier, a printer, a facsimile machine, or a multifunction peripheral including at least two functions of the copier, printer, and facsimile machine.

The sheets P serving as recording media may be thick paper, postcards, envelopes, plain paper, thin paper, coated paper, art paper, tracing paper, overhead projector (OHP) transparencies, plastic film, prepreg, copper foil, and the like.

A nip formation member disposed in the heating device according to the present disclosure is not limited to the nip formation pad in the fixing device described in the above embodiments. The heating device according to the present disclosure is also applicable to, for example, a heating device such as a dryer to dry ink applied to the sheet, a coating device (a laminator) that heats, under pressure, a film serving as a covering member onto the surface of the sheet such as paper, and a thermocompression device such as a heat sealer that seals a seal portion of a packaging material with heat and pressure. Applying the above-described features of the embodiments to the above-described devices can produce the above-described devices each having a simple configuration in which the base is easily assembled to the high thermal conduction member.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A nip formation pad comprising:

a base;

a high thermal conduction structure having a thermal conductivity greater than a thermal conductivity of the base, the high thermal conduction structure comprising a plate structure extending in a longitudinal direction of the nip formation pad and two bent portions bent from both ends of the plate structure in a short-side direction of the nip formation pad respectively, the high thermal conduction structure against which a pressure roller is pressed via a fixing belt to form a fixing nip; and an attachment attached to the high thermal conduction structure by elastic deformation of the attachment with the base held between the high thermal conduction structure and the attachment, wherein the high thermal conduction structure has a pair of full insertion holes inside and surrounded by the two bent portions respectively, wherein the attachment has a pair of insertion portions on both sides of the attachment in the short-side direction, and wherein the attachment is secured to the high thermal conduction structure by the pair of insertion portions inserted into the pair of insertion holes, respectively.

2. The nip formation pad according to claim 1, wherein the attachment is a flat spring.

3. A heating device comprising:

a rotatable belt;

an opposed rotator facing the belt; and the nip formation pad according to claim 1 in contact with an inner circumferential surface of the belt to form a nip between the belt and the opposed rotator.

4. The heating device according to claim 3, further comprising a stay supporting the nip formation pad, wherein the base has a positioning projection positioning the base with respect to the stay, and wherein the attachment has a positioning hole, and wherein the attachment is positioned with respect to the base with the positioning projection inserted into the positioning hole.

5. A fixing device comprising:

a rotatable fixing belt;

an opposed rotator facing the fixing belt; and the nip formation pad according to claim 1 in contact with an inner circumferential surface of the fixing belt to form a nip between the fixing belt and the opposed rotator.

6. An image forming apparatus comprising the fixing device according to claim 5.

7. The nip formation pad according to claim 1, wherein the high thermal conduction structure comprises bent portions bent from both ends in the short-side direction of the high thermal conduction structure and disposed along a longitudinal direction of the high thermal conduction structure;

the pair of insertion holes are respectively disposed in middle portions of the bent portions in the longitudinal direction, and an entire length, in the short-side direction, from an end of one of the insertion portions of the attachment to an end of the other of the insertion portions of the attachment is longer than an entire length, in the short-side direction, between the bent portions having the insertion holes.

* * * * *